US006074520A

United States Patent [19]

Marschke et al.

[11] Patent Number: 6,074,520

[45] Date of Patent: Jun. 13, 2000

[54] HEATED HOLDDOWN MAT FOR CORRUGATOR DOUBLE BACKER

[75] Inventors: Carl R. Marschke; Matthew J. Chuzles, both of Phillips; Kenneth D. Danielson, Prentice, all of Wis.

[73] Assignee: Marquip, Inc., Phillips, Wis.

[21] Appl. No.: 09/056,537

[22] Filed: Apr. 8, 1998

[51] Int. Cl.[7] ..... B30B 5/02; B30B 15/34

[52] U.S. Cl. ..... 156/583.3; 156/470; 156/583.91

[58] Field of Search ..... 156/470, 210, 156/205, 583.1, 583.3, 583.91, 462; 34/624; 432/8

[56] References Cited

U.S. PATENT DOCUMENTS

| | | | |
|---|---|---|---|
| 690,713 | 1/1902 | Ferres . | |
| 4,589,944 | 5/1986 | Torti et al. | 156/359 |
| 4,935,082 | 6/1990 | Bennett et al. | 156/205 |
| 5,183,525 | 2/1993 | Thomas | 156/470 |
| 5,256,240 | 10/1993 | Shortt | 156/470 |
| 5,561,918 | 10/1996 | Marschke | 34/629 |
| 5,891,302 | 4/1999 | Marschke . | |

*Primary Examiner*—Geoffrey L. Knable
*Assistant Examiner*—Gladys Piazza
*Attorney, Agent, or Firm*—Andrus, Sceales, Starke & Sawall

[57] ABSTRACT

A corrugator double backer includes a web holddown apparatus that provides both heat and a holddown force to the upper surface of the paperboard web to maintain the web in intimate drying contact with the lower heating units without the use of a conventional driven holddown belt. A heated holddown mat which is longitudinally and laterally flexible is provided by a series of generally parallel, somewhat flexible, closely spaced heating tubes which are suspended above the web in the heating section in catenary fashion in the direction of web travel. Lift devices on one or both ends of the mat of tubes can vary the amount of mat contact with the web and, therefore, the heat and load imposed on the web. The tubes are steam heated and have flat low friction, high wear resistant lower surfaces which lie directly atop the corrugated paperboard web running thereunder.

22 Claims, 4 Drawing Sheets

HEATED HOLDDOWN MAT FOR CORRUGATOR DOUBLE BACKER

BACKGROUND OF THE INVENTION

The present invention pertains to a variable heat transfer and adjustable holddown load device for a double backer for the production of corrugated paperboard in which the conventional driven web holddown belt is eliminated.

In a typical prior art double backer, a liner web is brought into contact with the glued flute tips of a single face corrugated web, and the freshly glued double face web is then passed over the surfaces of a number of serially arranged heating units, usually steam chests, to cause the starch-based glue to set and to drive moisture from the web. Double face web travel over flat heated surfaces of steam chests is typically provided by a wide driven holddown belt in direct contact with the upper face of corrugated web. The top face of the belt, in turn, is held in contact with the traveling web by any of several types of weight or force applying devices, well known in prior art. For example, the holddown belt may be engaged by a series of weighted ballast rollers, it may be forced into contact with the web by air pressure from a system of nozzles located over the web, or an arrangement of inflatable air bladders may be operated to press the moving holddown belt into contact with the double face web. It is also known to provide means for varying the ballast load applied to the holddown belt and web, both longitudinally in the machine direction and laterally in the cross machine direction.

The use of a driven holddown belt in a double backer has a number of attendant disadvantages. The holddown belt must be mounted for continuous travel in the manner of the conventional continuous conveyor belt system and, therefore, must also include a separate belt drive means. The holddown belt also must necessarily overlie the entire surface of corrugated web, at least in the heating section, and, as a result, may inhibit the escape of moisture from the board as it dries. Also, the edges of the belt which overhang the edges of the corrugated web run on the heating surfaces and are subject to wear.

It has also been found that, in the production of double wall corrugated paperboard, heat transfer from the underlying heating units to the freshly glued flute tips of the upper single face web is often irregular or insufficient to provide adequate green bond strength. As a result, the lower liner web may readily reach adequate green bond strength, but the bond between the upper single face web and the intermediate liner in the double wall board will be inadequate.

SUMMARY OF THE INVENTION

In accordance with the present invention, a double backer is provided in which the driven holddown belt is eliminated. In a preferred embodiment, a stationary heated holddown mat is suspended by its upstream and downstream ends to contact the entire web across its width and along the heating section. Adjustable mat end supports raise one or both mat ends to vary the heat and holddown force applied to the web.

The holddown mat includes a series of closely spaced imperforate heating tubes which are arranged in heat transfer communication with flat lower heating surfaces of the mat, which heating surfaces are adapted to lie in direct contact with the surface of the web. A heating source is provided to supply a heat transfer fluid to commonly oriented fluid inlet ends of the tubes, and a heating fluid collector receives the heat transfer fluid from commonly oriented fluid outlet ends of the tubes. At least one end of the mat is attached to a mat support which includes a lift device operative to move the mat end generally vertically with respect to the web to vary the length of the mat resting upon the web.

In a presently preferred embodiment, the heating tubes extend in the direction of web travel and the undersides of the tubes comprise the flat lower heating surfaces in contact with the web. Downstream and upstream mat supports are provided to which are respectively attached the commonly oriented fluid inlet ends of the tubes and the commonly oriented fluid outlet ends of the tubes. The downstream mat support includes a first heating fluid connection for supplying heat transfer fluid to the fluid inlet ends of the tubes and the upstream mat support includes a second heating fluid connection for receiving heat transfer fluid from the fluid outlet ends of the tubes. The first heating fluid connection is preferably connected to a source of steam and the second heating fluid connection is connected to a condensate receiver. The first heating fluid connection may comprise a steam supply header and include a steam hose connecting the header to each inlet tube end. The second heating fluid connection may comprise a condensate header and include a condensate hose connecting the condensate header to each tube outlet end.

The lift device is provided on the downstream mat support, but preferably a lift device is also provided for the upstream mat support. The mat also includes a series of ballast members which lie atop and extend generally transversely of the heating tubes. The ballast members may comprise elongate weights which are spaced apart along the length of the tubes and extend transversely to span at least the width of the web. The weights are preferably flexible and may comprise narrow flexible bags filled with a fluid ballast material. The ballast material may comprise sand.

The lower surfaces of the heating tubes are provided with a low friction, high wear resistant coating. In the preferred embodiment, the tubes comprise rectangular cross section metal extrusions, preferably made of aluminum. The low friction, high wear resistant coating may comprise a nickel plating and, optionally, a heat treated electroless nickel plating.

In the preferred embodiment, the inlet ends and the outlet ends of the tubes are provided with tube connectors which respectively connect the tube inlet ends and the tube outlet ends to the downstream and upstream mat supports. The inlet end tube connectors may be adjustable along the downstream mat support in a direction transverse to the direction of web travel.

DETAILED DESCRIPTION OF THE INVENTION

Figure 1:
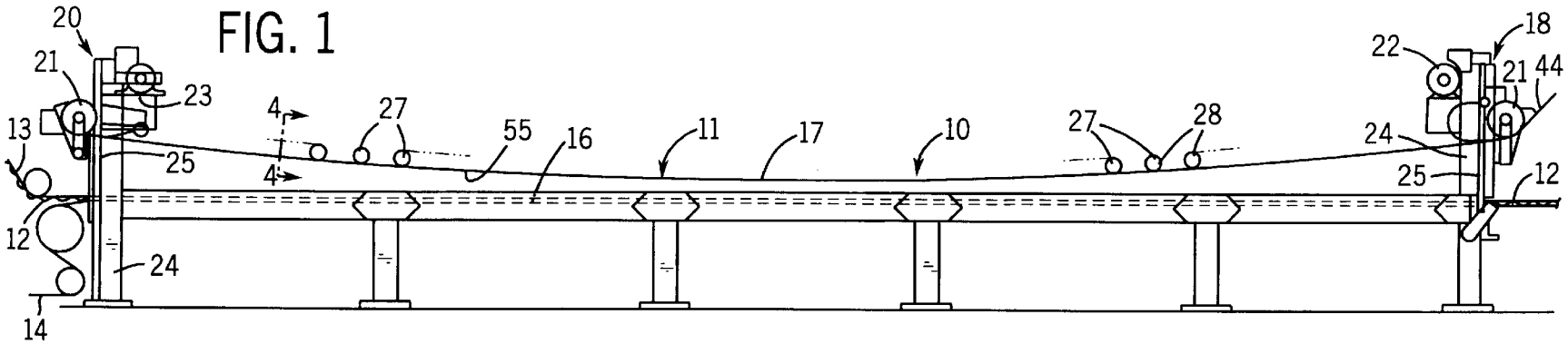
FIG. 1 is a side elevation view of a corrugator double backer incorporating the preferred embodiment of the present invention.
Figure 2:
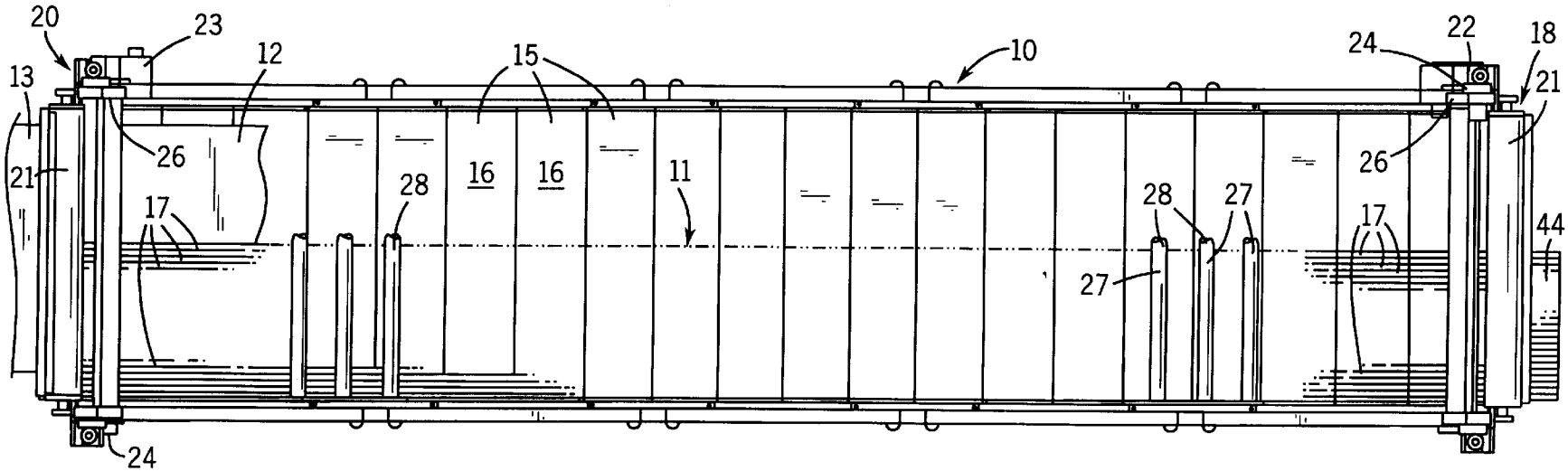
FIG. 2 is a top plan view of FIG. 1.
Figure 3:
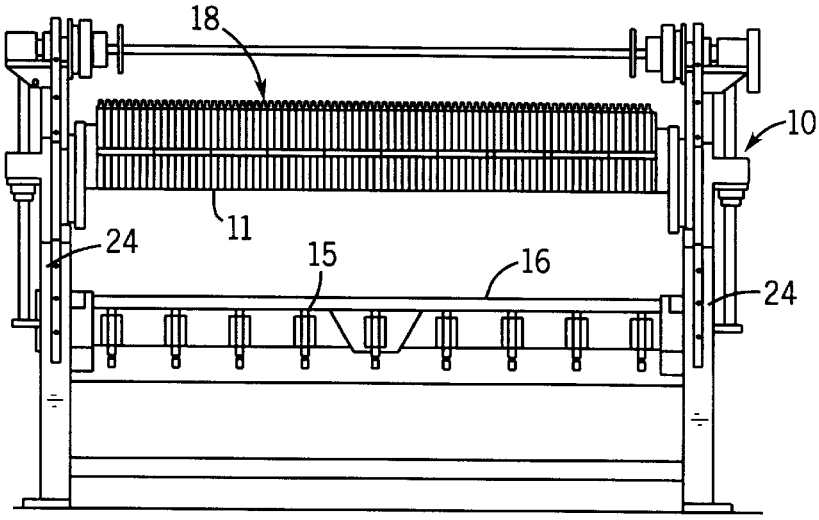
FIG. 3 is an end elevation view of the double backer shown in FIGS. 1 and 2 looking in the upstream direction.

FIGS. 1–3 show, in generally schematic form, a double backer 10 in which is incorporated the heated holddown mat 11 of the present invention. In a typical double backer, a double face corrugated web 12 is formed by joining a single face corrugated web 13 and a liner web 14. The flute tips of the corrugated medium of the single face web 13 are covered with an adhesive in an upstream glue machine (not shown) and the adhesive bond between the glued flute tips and the liner web 14 is cured by the application of heat and pressure in the double backer 10. In the manufacture of double wall corrugated board, another single face web (not shown) is glued to the upper liner of the single face web 13 and the composite web is processed through the double backer in the same manner.

Heat is supplied to the freshly glued double face web 12 from below by a series of heating units 15 having flat, co-planar heating surfaces 16 over which the web 12 travels through the double backer 10. The heating units may comprise individual steam chests which are fabricated of a heavy-walled cast iron or steel construction, but may also comprise any suitable flat web-supporting surface. One such heating unit of the latter type is disclosed, for example, in co-pending and commonly assigned application Ser. No. 08/682,206, filed Jul. 17, 1996, now U.S. Pat. No. 5,766, 409. Each heating unit 15 may be approximately 18–24 inches (about 462–610 mm) in length in the direction of web movement and have a width in the cross machine direction sufficient to fully support the maximum width of corrugated web 12 to be processed, e.g. 96 inches (2400 mm). The total length of the heating section provided by a series of heating units may be, for example, 40 feet (about 12 m).

Figure 4:
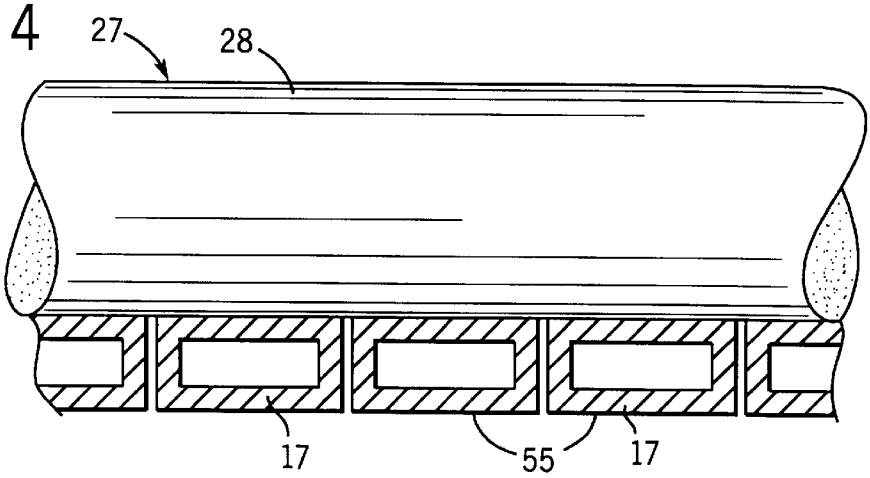
FIG. 4 is an enlarged sectional detail taken on line 4—4 of FIG. 1.
Figure 7:
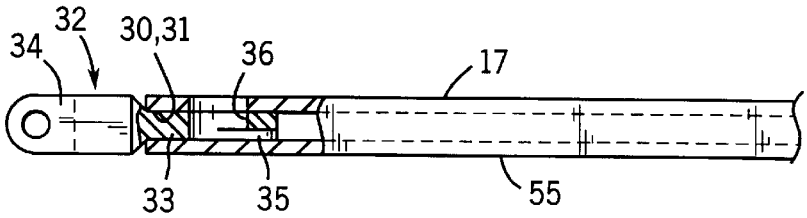
FIG. 7 is a side elevation detail of the end of a heating tube showing the tube connector attached thereto.
Figure 8:
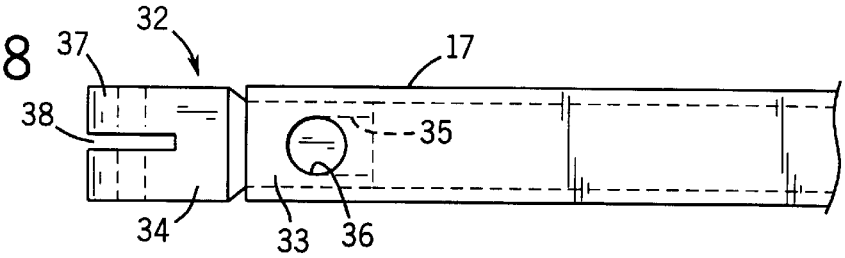
FIG. 8 is a top plan view of FIG. 7.

Heat and pressure to facilitate uniform heating and drying of the web and curing of the adhesive is applied to the upper surface of the web by the holddown mat 11. The mat 11 is preferably comprised of a series of closely spaced imperforate heating tubes 17, each of which extends the full length of the heating section and is attached at its opposite downstream and upstream ends to respective downstream and upstream mat supports 18 and 20. Referring also to FIG. 4, the heating tubes 17 are preferably made from rectangular cross section aluminum extrusions. The tubes may be about 1 inch (25 mm) wide and about ½ inch (12.5 mm) high and have a wall thickness of about ⅛ inch (3 mm). Although an extruded aluminum tube of the foregoing specifications is relatively rigid, when the tubes are suspended between the downstream and upstream mat supports 18 and 20, they tend to sag in a catenary manner, as shown in FIG. 1. In FIG. 2, the array of tubes 17 for only one-half the apparatus is shown, the other half being identical.

Each of the downstream and upstream mat supports 18 and 20 includes a large diameter cross tube 21 which provides for laterally spaced attachment of the ends of the heating tubes 17. The ends of the cross tubes 21 are attached to respective downstream and upstream lift mechanisms 22 and 23. Each of the downstream and upstream lift mechanisms 22 and 23 includes a pair of support frames 24 between which the cross tube 21 extends laterally across the double backer. Each of the support frames is provided with generally vertically extending linear ways 25 to each of which is slidably attached a cross tube end support 26. The cross tube end supports 26 for each downstream and upstream lift mechanism 23 and 24 are driven along the linear ways 25 with a suitable lift operating mechanism. The lift operator may comprise matched timing belts driven by a suitable electric motor-reducer or by a fluid cylinder operator. Other suitable lift drive mechanisms may also be utilized for each of the lift mechanisms 22 and 23.

In typical operation, the upstream lift mechanism 23 is operated to position the upstream end of the mat at its lowermost position such that the heating tubes 17 lie directly atop the double face web 12. Depending upon the amount of heat and force desired to be applied to the web passing through the double backer, the downstream lift mechanism 22 is positioned vertically so that the catenary in the holddown mat 11 results in a desired length of heating tubes 17 in contact with the double face web along the heating section.

A ballast to enhance the holddown force applied to the double face web 12 by the holddown mat 11 is provided with a series of ballast members 27 which are positioned to lie directly atop the heating tubes 17 to extend generally transversely thereof in the cross machine direction. The ballast members are longitudinally spaced in the machine direction. The ballast members are flexible and may conveniently comprise tubular bags 28 filled with sand or any other suitable granular or fluid ballast material. The bags 28 may be made of a glass reinforced fabric and may be 8 feet (about 2400 mm) long and 4 inches (about 100 mm) in diameter. The bags 28 of ballast material may be spaced in the machine direction (direction of web travel) on about 10 inch (255 mm) centers. The average load imposed on the web 12 with this arrangement is in the range of 13–15 pounds per square foot (about 620–720 Pa). Although the concentrated load directly under the ballast bags 28 is higher than the indicated average, this has not been found to affect uniform curing of the adhesive in the web. As indicated, although the heating tubes 17 are relatively stiff, they are nevertheless somewhat flexible because of their long lengths and because of their individual attachments to the downstream and upstream supports 18 and 20. Furthermore, because corrugated paperboard web has a very uniform caliper (thickness), the loading provided by the ballast carrying heating tubes 17 has been found to be quite uniform both along the length of the web and in the cross machine direction.

The heating tubes 17 are mounted to the downstream and upstream mat supports 18 and 20, respectively, in a manner which provides common orientation for the opposite fluid inlet ends 30 and fluid outlet ends 31 of the tubes. The common orientation of the respective inlet and outlet ends 30 and 31 of the tubes facilitates connection to a source of a heating fluid, such as steam, and to a reservoir for the cooled fluid, such as a condensate receiver. Referring also to FIGS. 5–8, each of the opposite inlet and outlet ends 30 and 31 of a heating tube 17 is closed with a connector 32. The connector facilitates both mechanical connection of the tube end to a support 18 or 20 and a fluid connection for the heat transfer fluid, either steam supply or condensate removal in the preferred embodiment. In the embodiment of the connector 32 shown in FIGS. 7 and 8, the connector has a reduced section attachment end 33 sized to be inserted into one of the heating tube ends 30 or 31 and to be welded in place. The attachment end 33 is provided with an open slot 35 which provides fluid communication from the interior of the tube through the tube wall via a bore 36 drilled through the tube and the attachment end 33 after attachment. The opposite connection end 34 of the connector 32 is provided with a clevis 37 which defines a slot 38 for a connecting link 40 (see FIGS. 5 and 6) connected to the clevis with a connecting pin 41.

Figure 5:
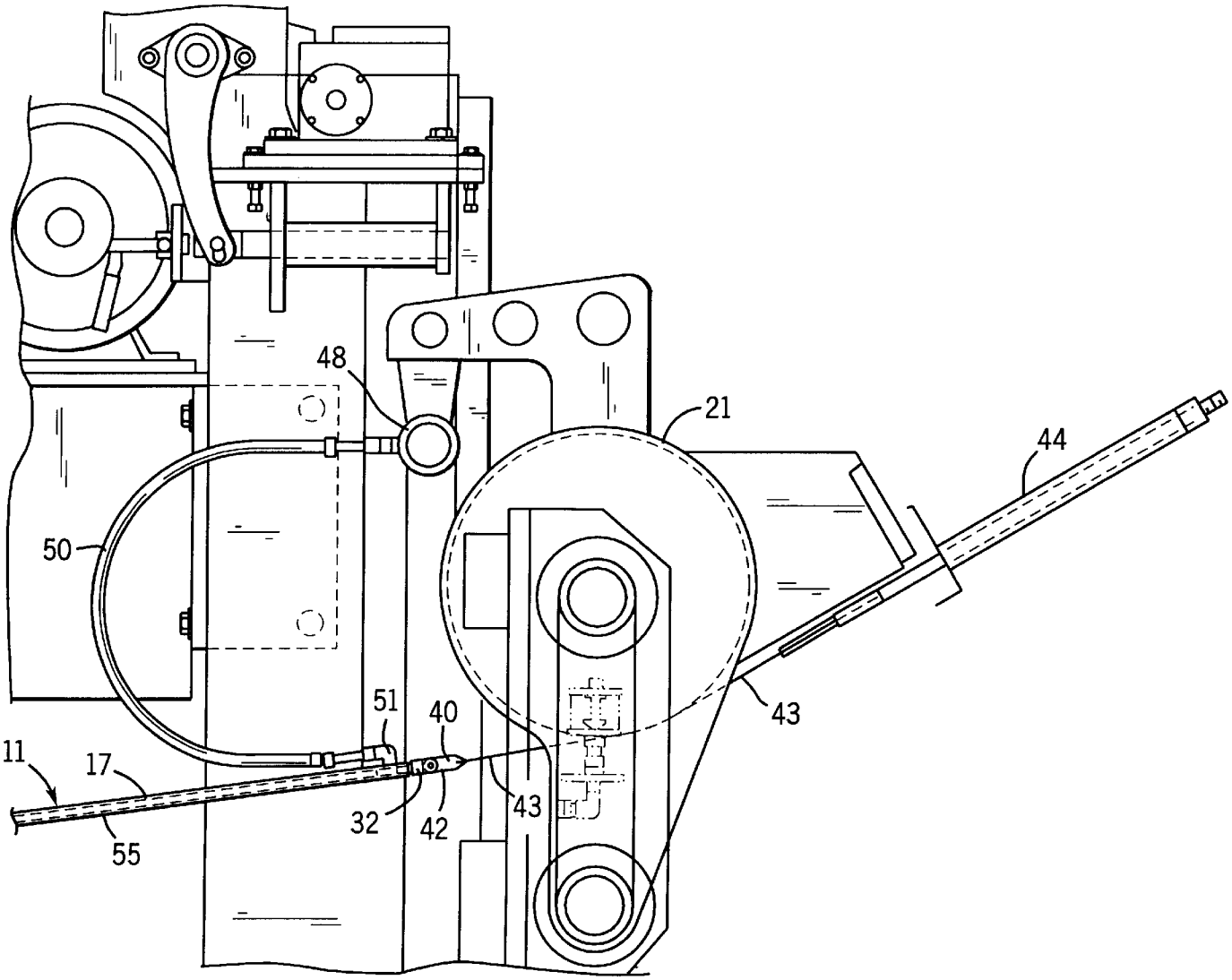
FIG. 5 is an enlarged detail of FIG. 1 showing the holddown mat support at the downstream end of the double backer.

In the detailed view of the downstream mat support 18 shown in FIG. 5, the connecting link 42 is attached by its downstream end to a flexible stainless steel strip 43 which is wrapped partially around the underside of the cross tube 21 and secured at its opposite end to a spring biased adjustment mechanism 44. The opposite upstream connecting link 45 has an upstream end which is provided with a cross pin 46 for demountable attachment to a mounting bracket 47 on the lower portion of the upstream cross tube 21. The downstream spring biased adjustment mechanism 44 allows individual adjustment of the tension in each heating tube 17 to allow adjustment for wear, thermal distortion, and the like.

Figure 6:
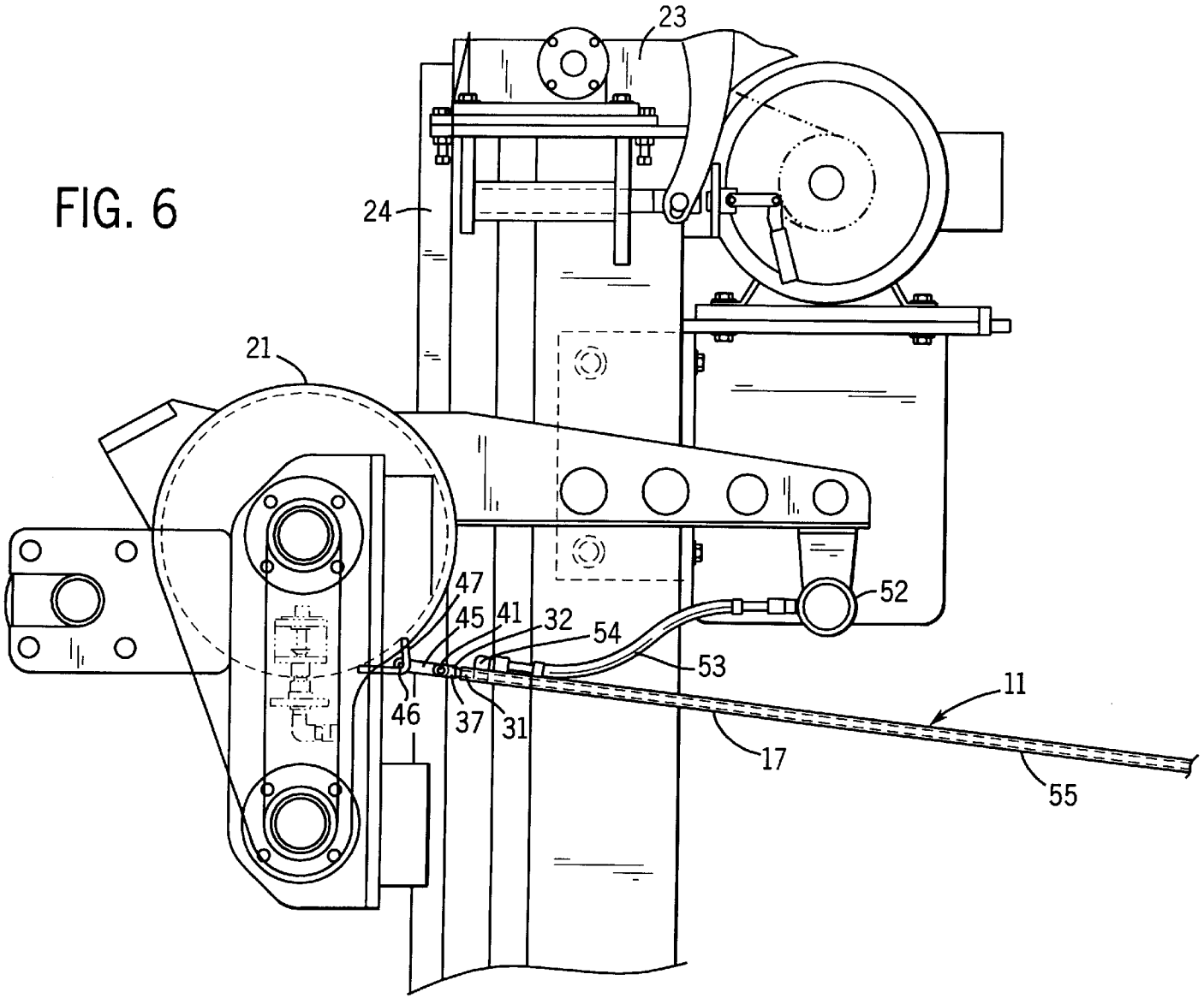
FIG. 6 is an enlarged detail of FIG. 1 showing the holddown mat support on the upstream end of the double backer.

Steam is applied from a source (not shown) to a steam header 48 attached to the downstream mat support 18 to move vertically therewith by operation of the downstream lift mechanism 22. The steam header 48 extends laterally across the double backer over the full width of the web and the full width of the array of generally parallel heating tubes 17. The steam header is provided with a series of steam hoses 50, each of which includes a downstream inlet connection 51 to the bore 36 in the inlet end 30 of a heating tube 17. Referring to FIG. 6, a condensate header 52 is mounted on the upstream cross tube 21 so that, in a manner similar to a steam header 48, the condensate header moves vertically with the upstream mat support 20 by operation of the upstream lift mechanism 23. The condensate header includes a series of condensate hoses 53, each of which is attached by an outlet connection 54 to the bore 36 in the outlet end 31 of a heating tube 17. Thus, live steam supplied from the steam header 48 to the commonly oriented inlet ends 30 of the heating tubes will travel in the upstream direction and exit as condensate via the commonly oriented outlet ends 31 to the condensate header 52, from which the condensate may be directed to a condensate receiver in a conventional manner.

The flat lower surfaces 55 of the heating tubes 17 are provided with low friction, high wear resistant coatings. The coating is important to reduce the drag on the double face web 12 traveling under the tubes and to reduce abrasive wear to the tube surfaces themselves. One presently preferred surface coating comprises an electroless nickel plating which may be subsequently heat treated to further enhance abrasive resistance.

The heating tubes 17 maybe mounted in generally parallel orientation and closely spaced, for example, about 1/16th inch (1.5 mm) apart. However, it is often desirable to support the heating tubes in a manner such that they diverge slightly from one another and laterally from the centerline of the machine in the downstream direction. Mounting the heating tubes 17 to diverge, for example such that their downstream ends are spaced apart by about 1/8th inch or 3 mm, provides a number of benefits. A divergent or splayed orientation of the heating tubes results in full contact by the lower surfaces 55 of the tubes and the web, i.e. eliminates the possibility of narrow machine direction lines of no contact. Further, divergence of the heating tubes 17 also helps to prevent edges of the paperboard web from being caught and torn in the spaces between the tubes. To facilitate adjustment in the positioning and spacing of the downstream ends 30 of the tubes, the individual tube connections provided by the spring biased adjustment mechanism 44 are also adjustable laterally in the cross machine direction to vary the spacing and to provide the desired downstream divergence between the heating tubes 17.

The ballast bags 28 may be allowed to rest directly on the tubes 17 without mechanical connection thereto. However, it is preferred that the bags be tied together with a suitable flexible connection, which may comprise the same material as used for the bags, and, in addition, the upstreammost and downstreammost ballast bags may be tied to the respective supports 20 and 18.

It is also possible to provide an alternate embodiment of the holddown mat 11 in which the heating tubes 17 are oriented in the cross machine direction (perpendicular to the preferred orientation described above). Longitudinal support for the cross machine oriented tubes could be provided by using stainless steel strips, similar in width and thickness to the downstream connecting strips 43, but which extend the full length of the double backer and are attached to the upstream cross tube 21 in a manner similar to attachment of the strips to the downstream cross tube (FIG. 5). The laterally oriented heating tubes are placed on top of the full length strips in intimate heat transfer contact therewith. The open ends of the heating tubes in this modified arrangement are preferably interconnected to provide a continuous serpentine path from a downstream inlet end on one tube in a longitudinal array to an upstream outlet end in the upstreammost tube of the array. Each array of tubes may comprise about 24 tubes and a number of such tube arrays appropriately arranged in longitudinally spaced relation along the length of the supporting strips. This embodiment requires multiple steam supply connections and multiple condensate return connections along the length of the heating section.

What is claimed is:

1. An apparatus for providing variable heat transfer and an adjustable holddown force to the upper surface of a laminated paperboard web traveling over a flat heated web-supporting surface in a corrugator double backer, said apparatus comprising:

a flexible mat extending over the web in the double backer in the direction of web travel between upstream and downstream mat ends, said mat providing a load directly to the web;

said mat including a series of closely spaced metal heating tubes of uniform cross section mounted to extend in the direction of web travel and to be suspended to hang in a common catenary curve, said tubes lying in direct heat transfer contact with the web and having flat imperforate lower heating surfaces adapted to lie in direct contact with the surface of the web;

a steam source providing steam to commonly oriented inlet ends of said tubes, and a condensate collector receiving steam condensate from commonly oriented outlet ends of said tubes;

upstream and downstream mat supports to which are attached the respective upstream and downstream mat ends; and, a lift device on one of said mat supports operative to move one mat end generally vertically with respect to the web to vary the length of the mat resting upon the web between substantially full mat length contact and no mat contact.

2. The apparatus as set forth in claim 1 wherein the lift device is operative to move the downstream mat end.

3. The apparatus as set forth in claim 1 wherein said heating tubes are attached by said inlet ends and said outlet ends respectively to the downstream and upstream supports.

4. The apparatus as set forth in claim 3 wherein said steam source comprises a steam supply header mounted on said downstream mat support and having steam connections to said tube inlet ends, and said condensate collector comprises a condensate header mounted on said upstream mat support and having condensate connections to said tube outlet ends.

5. The apparatus as set forth in claim 3 wherein said tubes comprise rectangular cross section aluminum tubes.

6. The apparatus as set forth in claim 5 wherein said aluminum tubes comprise extrusions and said lower tube surfaces comprise a hardened, friction-reducing plating.

7. An apparatus for providing variable heat transfer and an adjustable holddown force on the upper surface of a laminated paperboard web traveling over a flat heated web-supporting surface in a double backer, said apparatus comprising:

a flexible mat extending above and over the web in the direction of web travel between upstream and downstream mat ends, said mat providing a load directly to the upper surface of the web;

said mat including a series of laterally closely spaced extruded aluminum heating tubes extending in the direction of web travel and having smooth imperforate lower surfaces adapted to lie in direct contact with the surface of the web;

downstream and upstream mat supports mounting, respectively, commonly oriented steam inlet ends of said tubes and commonly oriented condensate outlet ends of said tubes;

said downstream mat support including a steam connection to said steam inlet ends and said upstream mat support including a condensate connection to said condensate outlet ends; and, a lift device on at least one of said mat supports operative to move the associated mat end generally vertically with respect to the web to suspend said at least one end of the mat to hang in a catenary curve and to vary the length of the lower surfaces of the tubes resting upon the web between a non-contact position and a substantially full length contact position.

8. The apparatus as set forth in claim 7 wherein said steam connection comprises a steam supply header and a steam hose connecting the header to each tube inlet end.

9. The apparatus as set forth in claim 8 wherein said condensate connection comprises a condensate header and a condensate hose connecting the condensate header to each tube outlet end.

10. The apparatus as set forth in claim 7 wherein the lift device is on said downstream mat support.

11. The apparatus as set forth in claim 7 wherein a lift device is provided for both of said mat supports.

12. The apparatus as set forth in claim 7 including a series of ballast members lying atop and extending generally transversely of said heating tubes.

13. The apparatus as set forth in claim 12 wherein said ballast members comprise elongate weights spaced along the length of the tubes and extending transversely at least the width of the web.

14. The apparatus as set forth in claim 13 wherein said weights are flexible.

15. The apparatus as set forth in claim 14 wherein said weights comprise narrow bags filled with a fluid ballast material.

16. The apparatus as set forth in claim 15 wherein the ballast material comprises sand.

17. The apparatus as set forth in claim 7 wherein the lower surface of said heating tubes are provided with a friction-reducing, wear resistant coating.

18. The apparatus as set forth in claim 7 wherein said tubes comprise rectangular cross section tubes.

19. The apparatus as set forth in claim 17 wherein the coating comprises a nickel plating.

20. The apparatus as set forth in claim 19 wherein the plating is a heat treated electroless nickel plating.

21. The apparatus as set forth in claim 7 including tube connectors attaching the inlet ends and outlet ends respectively to said downstream and upstream mat supports.

22. The apparatus as set forth in claim 21 wherein said inlet end tube connectors are individually adjustable along said downstream mat support in the direction of web travel to vary tension longitudinally in each tube.

* * * * *